US010549876B2

(12) United States Patent
Chu et al.

(10) Patent No.: US 10,549,876 B2
(45) Date of Patent: Feb. 4, 2020

(54) LABEL ATTACHING APPARATUS

(71) Applicants: BOE Technology Group Co., Ltd., Beijing (CN); Hefei BOE Optoelectronics Technology Co., Ltd., Anhui (CN)

(72) Inventors: Wangdong Chu, Beijing (CN); Jiaxiang Chen, Beijing (CN); Fuyong Cao, Beijing (CN); Jinjun Wang, Beijing (CN); Tao Chen, Beijing (CN); Peihuan Ning, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 472 days.

(21) Appl. No.: 15/135,740

(22) Filed: Apr. 22, 2016

(65) Prior Publication Data

US 2017/0088304 A1 Mar. 30, 2017

(30) Foreign Application Priority Data

Sep. 25, 2015 (CN) ..... 2015 1 0624845

(51) Int. Cl.
*B65C 9/08* (2006.01)

(52) U.S. Cl.
CPC ..... *B65C 9/08* (2013.01)

(58) Field of Classification Search
CPC ..... B65C 9/08; B65C 9/1815; B65C 9/1826; B65C 9/1876; B65C 9/1884
See application file for complete search history.

(56) References Cited

U.S. PATENT DOCUMENTS 4,337,108 A 6/1982 Crankshaw et al.
5,149,392 A * 9/1992 Plaessmann ..... B65C 1/02 156/541

(Continued)

FOREIGN PATENT DOCUMENTS

CN 102658900 A 9/2012
CN 103419982 A 12/2013

(Continued)

OTHER PUBLICATIONS

First Office Action, including Search Report, for Chinese Patent Application No. 201510624845.2, dated Nov. 23, 2016, 8 pages.

(Continued)

*Primary Examiner* — Philip C Tucker
*Assistant Examiner* — John Blades
(74) *Attorney, Agent, or Firm* — Westman, Champlin & Koehler, P.A.

(57) ABSTRACT

The present disclosure relates to a label attaching apparatus comprising a mounting base; an attaching plate having a first end which is connected to a first position on the mounting base and a second end which is a free end and provided with a label attaching unit; and a driving cylinder including a cylinder body and a piston rod retractable and extendable relative to the cylinder body, the cylinder body being connected to a second position on the mounting base, a distal end of the piston rod opposite to the cylinder body being connected to the attaching plate between the first and second ends of the attaching plate, wherein the first end of the attaching plate is hingedly connected onto the mounting base so that an orientation of the label attaching unit is able to be changed by the movement of the piston rod. With the label attaching apparatus, because an inclined angle of the attaching plate relative to a vertical direction can be changed through the forth and back movement of the piston rod, this (Continued)

inclining adsorbing structure can adjust an angle of the attaching plate according to a bend degree of a label, thereby an attaching angle can be adjusted at a larger extend, so that the label is easily attached with the attaching plate when being adsorbed by the attaching plate, which improves an attaching efficiency of the label.

8 Claims, 3 Drawing Sheets

(56) References Cited

U.S. PATENT DOCUMENTS

| | | | | |
|---|---|---|---|---|
| 5,421,948 | A * | 6/1995 | Crankshaw | B65C 1/04 156/486 |
| 2006/0027332 | A1 | 2/2006 | Dangami | |

FOREIGN PATENT DOCUMENTS

| | | | |
|---|---|---|---|
| CN | 103662233 | A | 3/2014 |
| CN | 104340448 | A | 2/2015 |
| DE | 10 2005 018 192 | A1 | 10/2006 |

OTHER PUBLICATIONS

Second Office Action for Chinese Patent Application No. 201510624845.2, dated May 9, 2017, 12 pages.

* cited by examiner

LABEL ATTACHING APPARATUS

CROSS-REFERENCE TO RELATED APPLICATION

This application claims the benefit of Chinese Patent Application No. CN201510624845.2 filed on Sep. 25, 2015 in the State Intellectual Property Office of China, the whole disclosure of which is incorporated herein by reference.

BACKGROUND OF THE INVENTION

Field of the Invention

Embodiments of the present invention generally relate to a label attaching apparatus, for example a label attaching apparatus for attaching a management label onto a product or a semi-finished product during manufacturing a liquid crystal device.

Description of the Related Art

Currently, in an automatic production of a liquid crystal device manufacturing industry, as shown in FIG. 1, a label automatic attaching apparatus comprises a L-shaped attaching plate 5, a driving cylinder 3, and a fixing shaft 8. A piston rod of the driving cylinder is fixedly connected to the L-shaped attaching plate 5, and the fixing shaft 8 is connected with the driving cylinder 3. The fixing shaft 8 moves upward and downward to control the apparatus to move up and down so as to adjust a position of the attaching plate 5 in a vertical direction. The piston rod of the driving cylinder 3 is movable forth and back to adjust a position of the attaching plate 5 in a horizontal direction. However, when the attaching plate 5 is pushed by the driving cylinder 3 moving in the horizontal direction to move forward or backward, a stroke of the piston rod is relatively long, and an occupied space of the apparatus is large. In addition, when being delivered to the attaching apparatus on a label conveyer, a label tends to be bent and declined during advancing at a certain angle relative to the horizontal direction. At this time, the label is only subjected to a vacuum adsorbing force and a gravity in the vertical direction. Due to a larger gap between the attaching plate and the label, a larger vacuum adsorbing force is required, and it is difficult to adjust vacuum degree, which results in a complicated operation. Further, a vertical adsorption results in a small adjusting range of a tore-off position of the label and thus is difficult for adjustment. Further, the L-shaped attaching plate 5 for adsorbing the label is typically provided with two rows of adsorbing holes, i.e., an upper row and a lower row, on an end plate thereof. The number of the adsorbing holes is typically 18 and a diameter of each adsorbing hole is relatively small. Therefore, the adsorbing holes are easily blocked and the maintenance is difficult after the adsorbing holes are blocked. Due to the large number of the adsorbing holes, it is more difficult to search a blocked adsorbing hole when an abnormity occurs.

Therefore, to address the above disadvantages, there is needed an improved label attaching apparatus.

SUMMARY OF THE INVENTION

Embodiments of the present invention are intended to overcome or alleviate at least one aspect of the above mentioned disadvantages.

To this end, an embodiment of the present invention provides a label attaching apparatus comprising: a mounting base; an attaching plate having a first end which is connected to a first position on the mounting base and a second end which is a free end and provided with a label attaching unit; and a driving cylinder including a cylinder body and a piston rod retractable and extendable relative to the cylinder body, the cylinder body being connected to a second position on the mounting base, a distal end of the piston rod opposite to the cylinder body being connected to the attaching plate between the first and second ends of the attaching plate, wherein the first end of the attaching plate is hingedly connected onto the mounting base so that an orientation of the label attaching unit is able to be changed by the retraction and extension movement of the piston rod.

According to an exemplary embodiment of the present invention, the piston rod is hingedly connected with the attaching plate.

According to an exemplary embodiment of the present invention, the cylinder body is hingedly connected with the mounting base.

According to an exemplary embodiment of the present invention, the label attaching apparatus further comprises a lift driving unit connected with the mounting base to move the piston rod upward and downward.

According to an exemplary embodiment of the present invention, the mounting base includes a first mounting plate provided with a connecting shaft on an upper surface thereof which is connected with the lift driving unit and a mounting stem on a lower surface thereof which is hinged with the cylinder body of the driving cylinder.

According to an exemplary embodiment of the present invention, the first end of the attaching plate is hinged onto a side of the first mounting plate.

According to an exemplary embodiment of the present invention, the mounting base further includes a second mounting plate secured to a side of the first mounting plate and extending in a direction intersecting a movable direction of the piston rod, the first end of the attaching plate being hinged onto the second mounting plate.

According to an exemplary embodiment of the present invention, the second mounting plate is provided with a through hole, through which the piston rod passes to be connected with the attaching plate.

According to an exemplary embodiment of the present invention, the attaching plate comprises a L-shaped plate including a first and second plate portions, the first plate portion of the L-shaped plate has an upper end hinged with the second mounting plate, and the second plate portion of the L-shaped plate has a lower surface provide with the label attaching unit.

According to an exemplary embodiment of the present invention, the label attaching unit is a vacuum adsorbing unit.

According to an exemplary embodiment of the present invention, the vacuum adsorbing unit is provided with a single row of adsorbing holes therein.

According to an exemplary embodiment of the present invention, the driving cylinder is an air cylinder.

According to the embodiments as described above, since the attaching plate is hinged with the mounting base, the piston rod is connected with the attaching plate, and a inclined angle of the attaching plate relative to a vertical direction can be changed through the forth and back movement of the piston rod, this inclining adsorbing structure can adjust an angle of the attaching plate according to a bend degree of a label, thereby an attaching angle can be adjusted in a larger extend, so that the label is easily attached with the attaching plate when being adsorbed by the attaching plate, which improves an attaching efficiency of the label.

Figure 1:
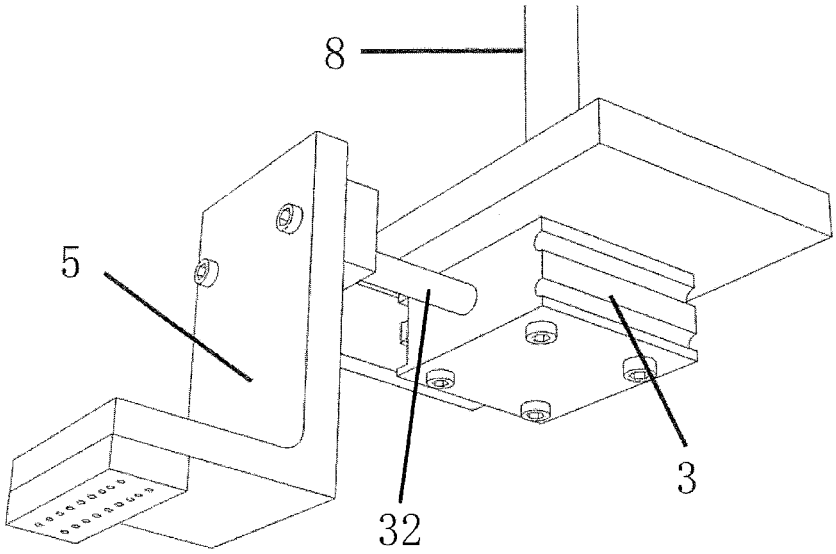
Prior Art Fig. 1
FIG. 1 is a structural view of a label automatic attaching apparatus in the prior art.

| Reference numerals: | | |
|---|---|---|
| 1 connecting shaft | 2 first mounting plate | 3 driving cylinder |
| 4 second mounting plate | 5 attaching plate | 6 vacuum adsorbing unit |
| 7 mounting base | 8 fixing shaft | |

DETAILED DESCRIPTION OF PREFERRED EMBODIMENTS OF THE INVENTION

Embodiments of the present invention will be clearly and completely described hereinafter with reference to the accompanying drawings in order to make objects, technical solutions and advantages of the embodiments thereof clearer. Obviously, the described embodiments are merely part of the embodiments of the present invention, rather than all of the embodiments of the present invention. Based on the embodiments of the present invention described herein, other embodiments acquired by the person skilled in the art without any inventive steps will be within the scope of the present invention.

Figure 2:
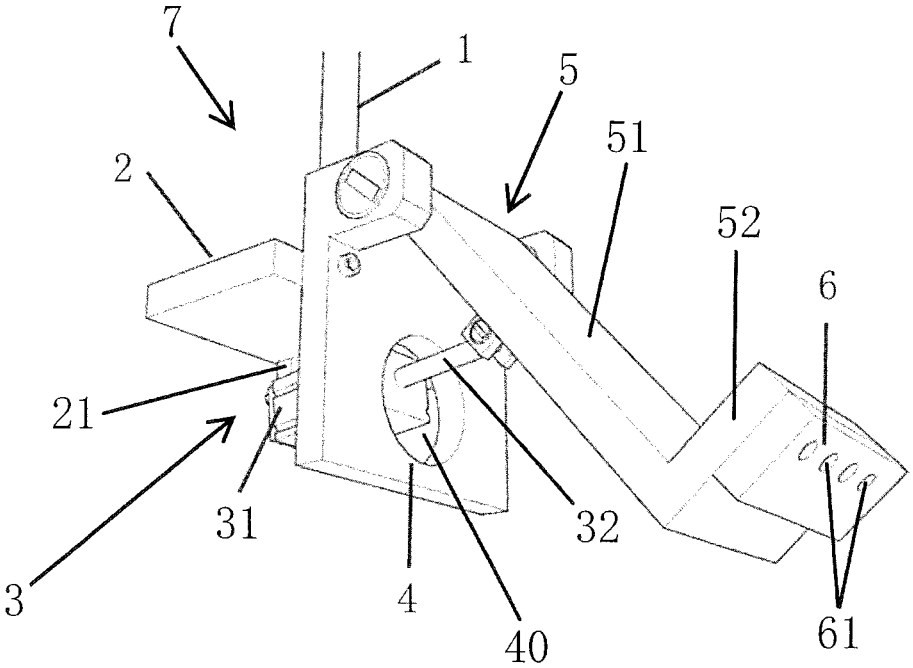
FIG. 2 is a structural view of a label attaching apparatus according to an exemplary embodiment of the present invention.

FIG. 2 shows a label attaching apparatus according to an embodiment of the present invention. The label attaching apparatus comprises a mounting base 7, a driving cylinder 3 and an attaching plate 5. The attaching plate 5 has a first end connected to a first position on the mounting base 7 and a second end which is a free end and provided with a label attaching unit 6. The driving cylinder 3 includes a cylinder body 31 and a piston rod 32 retractable and extendable relative to the cylinder body 31. The cylinder body 31 is connected to a second position on the mounting base 7, and a distal end of the piston rod 32 opposite to the cylinder body 31 is connected to the attaching plate between the first and second ends of the attaching plate 5. As illustrated in FIG. 2, the first end of the attaching plate 5 is hingedly connected on the mounting base 7, so that an orientation of the label attaching unit 6 can be changed through a forth and back movement of the piston rod.

According to the embodiment of the present invention as described above, since the attaching plate is hingedly connected with the mounting base, the piston rod is hingedly connected with the attaching plate, an inclined angle of the attaching plate relative to a vertical direction can be changed through the forth and back movement of the piston rod. This inclining adsorbing structure can adjust an angle of the attaching plate according to a bending degree of a label, thereby an attaching angle can be adjusted at a large extend, so that the label is easily attached to the attaching plate when being adsorbed by the attaching plate, which improves efficiency of attaching the label.

Further, as depicted in FIG. 2, the piston rod 32 and the attaching plate 5 are also hinged with each other. In this way, when the attaching plate 5 pivots about a pivot axis, a connecting portion between the piston rod 32 and the attaching plate 5 will not be subjected to much stress, so that the attaching plate 5 can move smoothly. Furthermore, since the piston rod 32 is hinged with the attaching plate 5, it is possible to further adjust a pivoting angle of the attaching plate 5 so as to reduce a stoke distance thereof.

Further, according to an exemplary embodiment of the present invention, the cylinder body 31 and the mounting base 7 are also hinged with each other. In this way, on one hand, it is possible to eliminate a stress generated at a connecting portion between the cylinder body 31 and the mounting base 71, thereby prolonging a life of the apparatus; on the other hand, it also facilitates to reduce the stoke distance of the attaching plate.

As shown in FIG. 2, the mounting base 7 is connected with a lift driving unit (not shown) by a connecting shaft 1 to move upward and downward. The attaching plate 5 is hinged onto one side of the mounting base 7.

Specifically, according to an exemplary embodiment of the present invention, the mounting base 7 includes a substantially horizontal first mounting plate 2. The first mounting plate 2 has an upper surface connected with the lift drive unit by the connecting shaft 1 so as to move upward and downward and a lower surface provided with a mounting stem 21 hinged with the cylinder body 31 of the driving cylinder 3. The attaching plate 5 may be hinged onto a side surface of the first mounting plate 2.

According to other embodiments of the present invention, as illustrated in FIG. 2, the mounting base 7 further includes a second mounting plate 4 substantially perpendicular to the first mounting plate 2. The second mounting plate 4 is mounted on the side surface of the first mounting plate 2 to intersect an movable direction of the piston rod 32 of the driving cylinder 3. The attaching plate 5 may be hinged onto the second mounting plate 4.

According to an exemplary embodiment of the present invention, the second mounting plate 4 is provided with a through hole 40, through which the piston rod 32 of the driving cylinder 3 passes. The piston rod 32 of the driving cylinder 3 is hinged with the attaching plate 5 through the through hole 40.

Specifically, according to an exemplary embodiment of the present invention, as shown in FIG. 2, the attaching plate 5 includes a L-shaped plate and a vacuum adsorbing unit 6 as a typical example of the label attaching unit. The second mounting plate 4 is hinged with an upper end of a long plate (a first plate portion) 51 of the L-shaped plate to control the inclination angle of the attaching plate relative to the vertical direction, and a short plate (a second plate portion) 52 of the L-shaped plate is provided with the vacuum adsorbing unit 6 on a lower surface thereof. The vacuum adsorbing unit 6 is provided with a single row of adsorbing holes therein.

Typically, the cylinder 3 is an air cylinder by which the control is easier.

During use, the lift driving unit is connected with the connecting shaft 1 to control the connecting shaft 1 to move upward and downward so as to bring the mounting base connected with connecting shaft 1 to move up and down so as to control a position of the attaching plate 5, which is mounted on the mounting base, in the vertical direction. After the attaching plate 5 arrives at a target position, the piston rod of the cylinder extends to push the attaching plate 5 hinged with the piston rod of the cylinder so as to change the inclination angle of the attaching plate 5 relative to the vertical direction. The second mounting plate 4 of the mounting base is hinged with the upper end of the longer plate of the L-shaped plate, and the cylinder body is hinged with the lower surface of the first mounting plate 2 of the mounting base. Therefore, when the piston rod 32 of the cylinder pushes the attaching plate 5 to rotate at a certain angle, the cylinder 3 also rotates a certain angle to change an attitude of the attaching plate 5, so that the inclination angle of the attaching plate 5 can be varied relative to a vertical direction.

Figure 3:
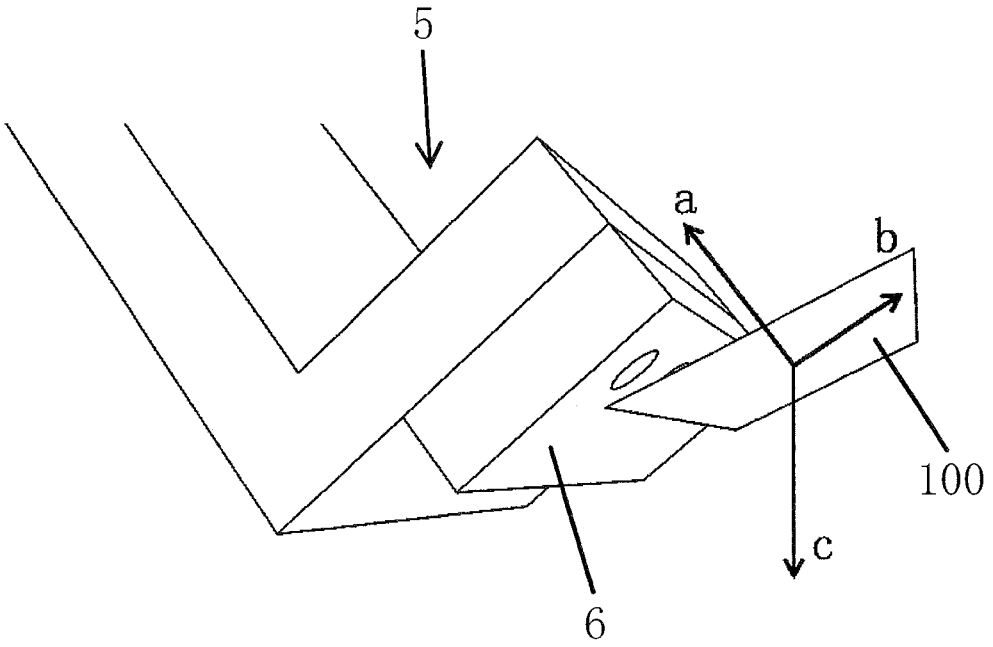
FIG. 3 is a schematic view showing forces applied to a label in the label attaching apparatus as shown in FIG. 2.
Figure 5:
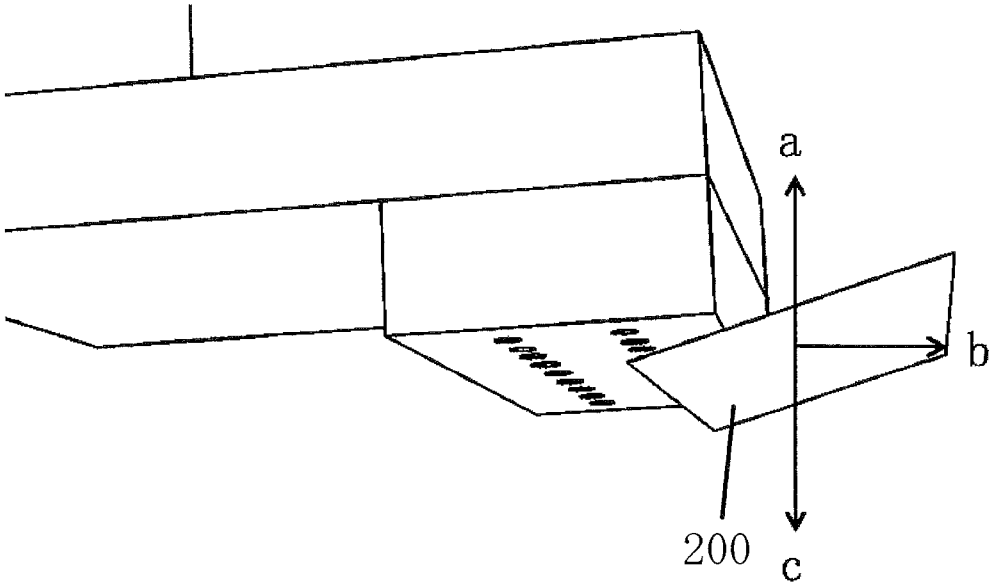
Prior Art Fig. 5
FIG. 5 is a schematic view showing forces applied to the label in the label attaching apparatus in the prior art.

As shown in FIG. 3, when a label 100 is delivered to the attaching apparatus on a label conveyor, the label 100 tends to bend and decline at a certain angle in a forward direction. When the label is stripped off or adsorbed by the inclining attaching plate 5, the attaching plate 5 approaches the label, and the angle of the attaching plate 5 can be adjusted based on the bending degree of the label. After the vacuum adsorbing unit 6 disposed on the lower surface of the short plate 52 of the L-shaped plate of the attaching plate 5 and the label 100 are attached with each other by adsorption, the label 100 is subjected to a vertical downward gravity c, an upward vacuum adsorbing force a perpendicular to an adsorption surface in which the adsorbing holes exist and a resistance b opposite to the forward direction of the label 100 along a contact surface, i.e., a resistance between the label and the vacuum adsorbing unit 6 on the lower surface of the short plate of the L-shaped plate. During the whole attachment of the label and the attaching plate 5, the label is always subjected to the resistance b opposite to the forward direction along the contact surface. As compared to the existing attachment; the additional resistance b opposite to the forward direction of the label will balance the force applied to the label and improve stability of the adsorbing position of the label. That is, the three forces a, b and c are balanced in horizontal and vertical directions. Therefore, a stop position of the label is stable and easily controlled. However, as shown in FIG. 5, in the prior art, the label 200 is subjected to balanced force in the vertical direction, but is not subjected to balanced force in the horizontal direction. Thus, the movement of the label in the horizontal direction is not stable, i.e., the position of the label on the vacuum adsorbing unit 6 on the lower surface of the short plate of the L-shaped plate is not stable.

Figure 4:
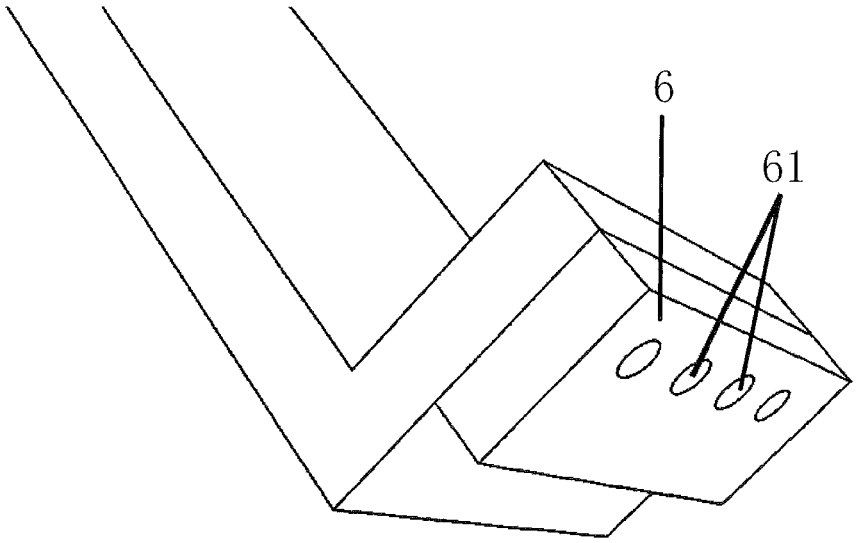
FIG. 4 is a structural view of a vacuum adsorbing unit of an attaching plate in a label attaching apparatus according to an exemplary embodiment of the present invention.

As illustrated in FIGS. 3 and 4, due to the inclining adsorption, the attaching plate 5 can be adjusted to an angle conforming with the bending degree of the label, and a gap between the attaching plate 5 and the label is reduced during the attachment, thus a vacuum adsorption force required is decreased accordingly. Therefore, in the present disclosure, the vacuum adsorbing unit 6 may be only provided with the single row of adsorbing holes therein and the number of the adsorbing holes may be reduced to four. At the same time, a diameter of the adsorbing hole is enlarged so that blocking of the adsorbing holes is alleviated, thereby it is more convenient to perform clean and maintenance operations.

As described above, in the present disclosure, an adsorbing attitude of the label is changed from an horizontal adsorption to a tilting adsorption by controlling the attaching plate hinged with the mounting base to rotate at a certain angle by driving the piston rod of the cylinder to move forth and back. As a result, the label is subjected to an additional resistance force opposite to the forward direction when being attached, which balances the forces applied to the label during the attachment, so that it is easy to adjust the positions of the label when being attached or stripped-off. Therefore, the attaching position of the label is easily adjusted, and the stability of the label is improved. By means of the tilting adsorption, the attaching plate can be adjusted to the angle conforming with the bending degree of the label, and the gap between the attaching plate 5 and the label is reduced, thus a vacuum adsorption force required is decreased accordingly, and the attaching stroke becomes short and the attaching speed is speeded up. In addition, an operator may quickly find out the abnormity of the apparatus, which improves a handling speed of the apparatus halt, thereby improving operation rate and efficiency and effectively solving the problem that the time of upstream and downstream procedures increase due to low speed of the printing or attaching. Further, less number and lager diameter of the adsorbing holes allow the blocking of the adsorbing holes to be alleviated, thus it is more convenient to perform the clean and maintenance operations.

When the attaching operation is completed, the attaching plate 5 may be switched to the horizontal attitude from the tilt attitude by the cylinder 3. The attaching plate 5 in the horizontal attitude can move above a product to be attached with a label by a vertical driving cylinder. Thereafter, the adsorbing vacuum of the adsorbing plate is broken, and the label is attached onto a surface of the product by a positive air pressure.

The above embodiments are only intended to illustrate the technical solution of the present invention, rather than being construed as a limitation thereto. Although embodiments of the disclosure have been described in detail with reference to the accompanying drawings, it would be appreciated by those skilled in the art that various changes or modifications may be made to the embodiments of the present invention or equivalent substitutions may be made to a part of technical features. These changes, modifications or equivalent substitutions will still fall within the spirit and scope defined by claims of the present invention.

What is claimed is:

1. A label attaching apparatus comprising:

a mounting base;

an attaching plate having a first end which is connected to a first position on the mounting base and a second end which is a free end and provided with a label attaching unit; and a driving cylinder including a cylinder body and a piston rod retractable and extendable relative to the cylinder body, the cylinder body being connected to a second position on the mounting base, a distal end of the piston rod opposite to the cylinder body being connected to the attaching plate between the first and second ends of the attaching plate, wherein the first end of the attaching plate is hingedly connected onto the mounting base so that an orientation of the label attaching unit is able to be changed by the retraction and extension movement of the piston rod; and wherein the mounting base includes a first mounting plate provided with a connecting shaft on an upper surface thereof, and a mounting stem on a lower surface thereof, which is hinged with the cylinder body of the driving cylinder;

wherein the mounting base further includes a second mounting plate, which is secured to a side of the first mounting plate and is provided with a through hole and extends such that the piston rod passes through the through hole and is connected with the attaching plate, the first end of the attaching plate being hinged onto the second mounting plate; and wherein the attaching plate comprises a L-shaped plate including a first plate portion and a second plate portion, the first plate portion of the L-shaped plate has an upper end hinged with the second mounting plate, and the second plate portion of the L-shaped plate has a lower surface provided with the label attaching unit.

2. The label attaching apparatus according to claim 1, wherein the piston rod is hingedly connected with the attaching plate.

3. The label attaching apparatus according to claim 1, further comprising a lift driving unit connected with the mounting base to move upward and downward a connecting shaft which is located on an upper surface of the mounting base and connected with the lift driving unit.

4. The label attaching apparatus according to claim 1, wherein the first end of the attaching plate is hinged onto a side of the first mounting plate.

5. The label attaching apparatus according to claim 1, wherein the label attaching unit is a vacuum adsorbing unit.

6. The label attaching apparatus according to claim 5, wherein the vacuum adsorbing unit is provided with a single row of adsorbing holes therein.

7. The label attaching apparatus according to claim 1, wherein the driving cylinder is an air cylinder.

8. A label attaching apparatus comprising:

a mounting base;

an attaching plate having a first end which is connected to a first position on the mounting base and a second end which is a free end and provided with a label attaching unit; and a driving cylinder including a cylinder body and a piston rod retractable and extendable relative to the cylinder body, the cylinder body being connected to a second position on the mounting base, a distal end of the piston rod opposite to the cylinder body being connected to the attaching plate between the first and second ends of the attaching plate, wherein the first end of the attaching plate is hingedly connected onto the mounting base so that an orientation of the label attaching unit is able to be changed by the retraction and extension movement of the piston rod; and wherein the mounting base includes a first mounting plate provided with a connecting shaft on an upper surface thereof, and a mounting stem on a lower surface thereof, which is hinged with the cylinder body of the driving cylinder; and wherein the mounting base further includes a second mounting plate, which is secured to a side of the first mounting plate and is provided with a through hole and extends such that the piston rod passes through the through hole and is connected with the attaching plate, the first end of the attaching plate being hinged onto the second mounting plate.

* * * * *